US008111850B2

(12) United States Patent
Messmer et al.

(10) Patent No.: US 8,111,850 B2
(45) Date of Patent: Feb. 7, 2012

(54) METHOD FOR ADJUSTING A HEARING DEVICE WITH A STANDARDIZATION OF PROCESSING VALUES

(75) Inventors: Michael Messmer, Erlangen (DE); Andre Steinbuss, Erlangen (DE)

(73) Assignee: Siemens Adiologische Technik GmbH, Erlangen (DE)

( * ) Notice: Subject to any disclaimer, the term of this patent is extended or adjusted under 35 U.S.C. 154(b) by 985 days.

(21) Appl. No.: 12/079,684

(22) Filed: Mar. 28, 2008

(65) Prior Publication Data

US 2008/0240478 A1 Oct. 2, 2008

(30) Foreign Application Priority Data

Mar. 29, 2007 (DE) ..... 10 2007 015 181

(51) Int. Cl.
*H04R 25/00* (2006.01)

(52) U.S. Cl. ..... 381/320; 381/60

(58) Field of Classification Search ..... 381/320, 381/60

See application file for complete search history.

(56) References Cited

U.S. PATENT DOCUMENTS 6,931,137 B2 * 8/2005 Arndt et al. ..... 381/83
2004/0028250 A1 * 2/2004 Shim ..... 381/312

FOREIGN PATENT DOCUMENTS

DE 10152197 A1 5/2003
EP 0917397 A1 5/1999

* cited by examiner

*Primary Examiner* — Tu-Tu Ho

(57) ABSTRACT

A hearing device wearer is to have improved possibilities of being able to perform a fine adjustment of his/her hearing device according to a basic setting. To this end, each processing value of a multi-channel processing system is standardized, in particular a filter bank, to a respectively associated basic setting value. A fine adjustment of the processing values to the hearing device wearer can now be carried out in relation to the standardized processing values starting from a standardized base line. It is thus possible for the hearing device wearer to implement a standardization of the setting values at any point in time and based hereupon to intuitively perform his/her setting requests.

7 Claims, 3 Drawing Sheets

METHOD FOR ADJUSTING A HEARING DEVICE WITH A STANDARDIZATION OF PROCESSING VALUES

CROSS REFERENCE TO RELATED APPLICATIONS

This application claims priority of German application No. 10 2007 015 181.2 DE filed Mar. 29, 2007, which is incorporated by reference herein in its entirety.

FIELD OF INVENTION

The present invention relates to a method for adjusting a hearing device which has a multi-channel processing unit to a hearing device wearer by setting each individual processing value for each channel of the processing unit to a respective basic setting value which is individual to the hearing device wearer.

BACKGROUND OF INVENTION

Hearing devices are portable hearing apparatuses which are used to supply the hard-of-hearing. To accommodate the numerous individual requirements, different configurations of hearing devices such as behind-the-ear hearing devices (BTE), in-the-ear hearing devices (ITE), e.g. including concha hearing devices or channel hearing devices (CIC), are provided. The hearing devices detailed by way of example are worn on the outer ear or in the auditory canal. Furthermore, bone conduction hearing aids, implantable or vibrotactile hearing aids are also available on the market. In such cases the damaged hearing is stimulated either mechanically or electrically.

Essential components of the hearing devices include in principle an input converter, an amplifier and an output converter. The input converter is generally a receiving transducer, e.g. a microphone and/or an electromagnetic receiver, e.g. an induction coil. The output converter is mostly realized as an electroacoustic converter, e.g. a miniature loudspeaker, or as an electromechanical converter, e.g. a bone conduction receiver. The amplifier is usually integrated into a signal processing unit. This basic configuration is shown in the example in FIG. 1 of a behind-the-ear hearing device. One or a number of microphones 2 for recording the ambient sound are incorporated in a hearing device housing 1 to be worn behind the ear. A signal processing unit 3, which is similarly integrated into the hearing device housing 1, processes the microphone signals and amplifies them. The output signal of the signal processing unit 3 is transmitted to a loudspeaker and/or receiver 4, which outputs an acoustic signal. The sound is optionally transmitted to the ear drum of the device wearer via a sound tube, which is fixed with an otoplastic in the auditory canal. The power supply of the hearing device and in particular of the signal processing unit 3 is provided by a battery 5 which is likewise integrated into the hearing device housing 1.

The sound of a hearing device and/or hearing system is essentially characterized by the frequency-dependent amplification. When preadjusting the hearing device, this is realized in any number of channels with the aid of calculated target amplification curves by attenuations of different levels of individual channels. In addition, the individual electroacoustics are taken into consideration by setting these channels. In this way, resonances of a hearing system are compensated for for instance. The result of the basic setting is thus a precalculated frequency response of the hearing system, which is composed of different settings of the channel filter bank and the individual electroacoustics.

The basic setting is however generally only a starting point for the hearing device adjustment and, as adjustment proceeds, the adjusting audiologist is asked to shape the frequency response on the basis of the requirements of his/her customer. To this end, he/she has access to the filter bank and can adjust the attenuation of the individual channels.

Modern hearing systems have a number of channels so that the realization of user and/or customer wishes on a large filter bank does not always appear simple. To illustrate this, FIG. 2 shows a typical result of a channel attenuation following the basic setting for a 16 channel device. The figure shows an equalizer setting over 16 channels, which are arranged next to one another with increasing frequency. The setting value for each channel k1, k2, . . . , k16 is symbolized optically by an actuation element b1, b2, . . . , b16, as with an equalizer. The position of each actuation element b1, b2, . . . , b16 thus represents the adjusted filter and/or attenuation value for the respective channel k1, k2, . . . , k16. In the event of the configuration only being displayed optically, for instance on a computer monitor, the rectangles b1, b2, . . . , b16 do not represent physical actuation elements, but instead only graphical symbols for instance, which can be dragged with a computer mouse and/or only represent the respective setting value of the channel.

SUMMARY OF INVENTION

In this view shown in FIG. 2, it is however relatively unclear how to realize a customer wish, such as for more amplification in the high frequencies for example. Furthermore, following a change in the basic setting, it is barely possible to reliably revert to this setting once again.

This problem was previously solved by way of what are known as "wizards", which provide suggestions for a specific customer problem and apply these on request. Nevertheless, even with this help, there is no possibility of visualizing the extent of the changes in a simple fashion. Alternatively, adjusting modules offer the possibility of displaying the set level in the individual channels, which is however of little assistance to a further intuitive adjustment.

The object of the present invention thus consists in improving the fine adjustment of hearing devices by using aids which act intuitively.

In accordance with the invention, this object is achieved by a method for adjusting a hearing device which has a multi-channel processing unit to a hearing device wearer by setting each individual processing value for each channel of the processing unit to a respective basic setting value which is individual to the hearing device wearer, standardizing each of the processing values to the respectively associated basic setting value and further adjustment of the processing values to the hearing device wearer relative the standardized processing values.

It is thus advantageously possible to implement a standardization of the setting values following a basic adjustment so that they lie on a straight line when displayed graphically for instance. Based on this, further adjustments are easily and intuitively possible.

Preferably, the processing unit is a filter bank and the processing values are filter values. It is thus easily possible to intuitively set the attenuation values of a filter bank. The advantage according to the invention can however also be used for instance for an amplifier unit as a processing unit.

It is particularly advantageous for the basic setting values and the relative adjustments of the processing values to be optically displayed for each channel. Optical displays aid the user with finding intuitively suitable setting values.

It is also advantageous if a maximum value for the further adjustment for each channel is shown optically together with the current setting values, which cannot be exceeded with the relative adjustment. It is thus possible for not only the dynamic range of the processing unit in the respective channel to be easily detected, but it is also easily possible to identify that in some circumstances other channels can or are to be influenced for the realization of the desired filtering and/or processing.

The relative adjustment can be carried out with the aid of a drop-down menu, with which one of several predetermined relative adjustment value combinations, which illustrate the relative adjustment values for all channels, can be selected. Comparatively simple individual relative settings and/or fine adjustments are thus also possible for certain hearing situations. A relative rise in the adjustment values can thus take place for instance in only those channels which represent a middle range of acoustically perceptible frequencies. In this way, voice signals can be reproduced in an amplified fashion in relation to other noises for instance.

BRIEF DESCRIPTION OF THE DRAWINGS

The present invention is described in more detail with reference to the appended drawings, in which.

DETAILED DESCRIPTION OF INVENTION

The exemplary embodiments illustrated in more detail below represent preferred embodiments of the present invention.

Figure 1:
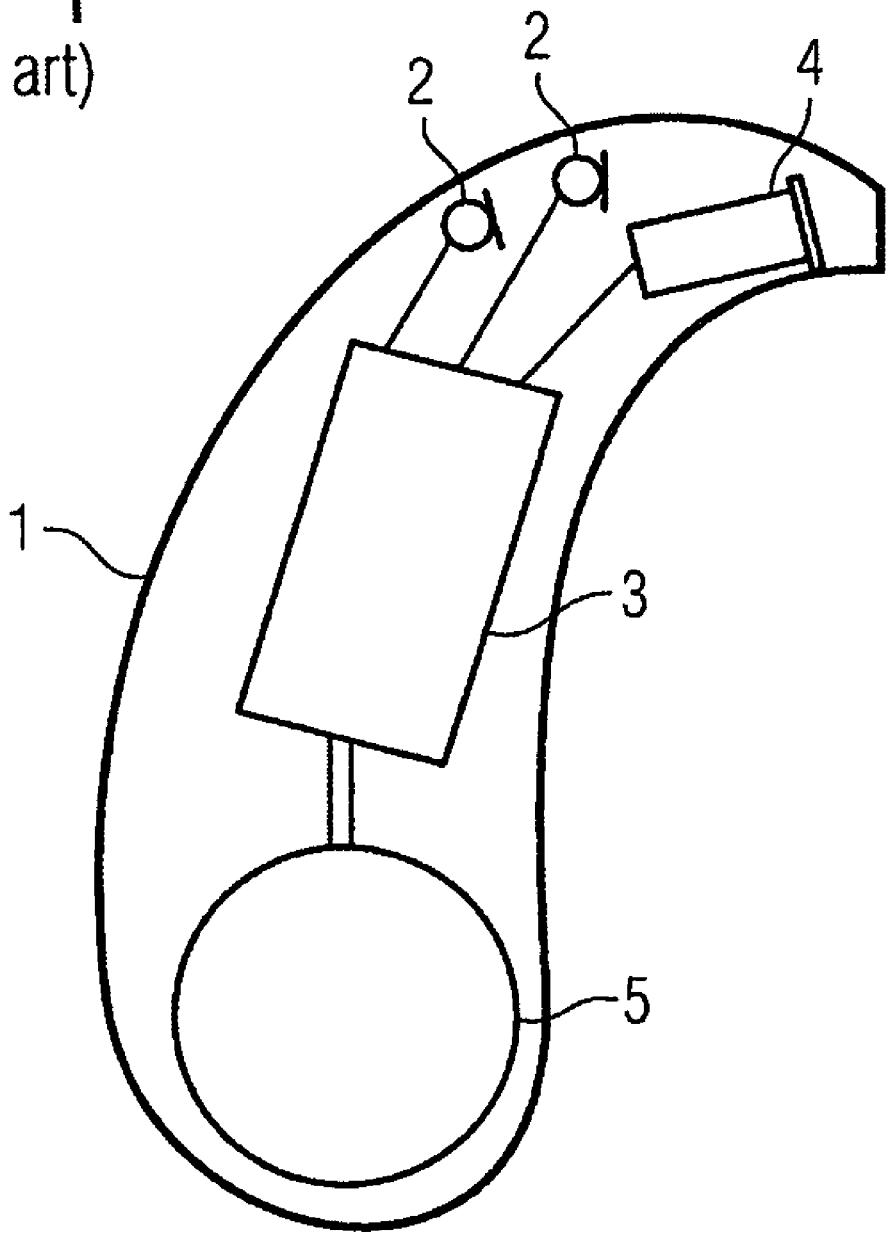
FIG 1 (Prior art)
FIG. 1 shows the basic design of a hearing device according to the prior art.
Figure 2:
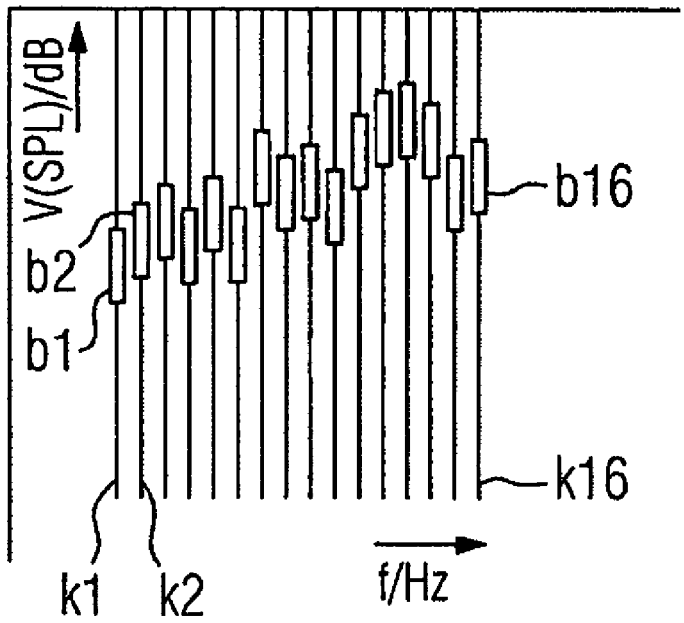
FIG 2 (Prior art)
FIG. 2 shows a typical configuration of a 16 channel filter bank according to a basic adjustment in accordance with the prior art.
Figure 3:
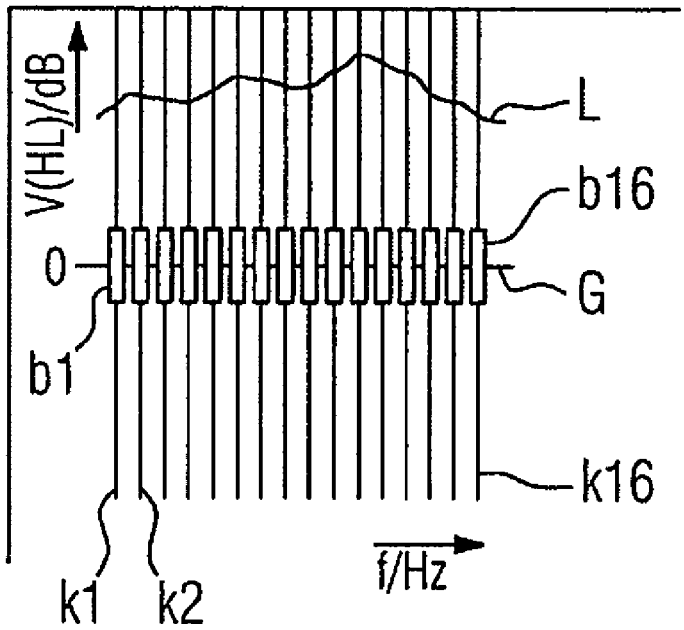
FIG. 3 shows a standardized representation of the setting values of FIG. 2 according to the present invention.

For better intuitive usability of a filter bank configuration or another setting of a multi-channel system, the previous absolute representation of the channel level according to FIG. 2 is transformed in accordance with the invention into a relative representation according to FIG. 3. In this way, the setting value of each channel k1 to k16 is standardized to the value of the respective basic setting, in the present case the value shown in FIG. 2. The actuation elements b1 to b16 are thus automatically aligned to a base line G, e.g. a 0 line. A standardization of this type can take place at any point in time.

The graphics in FIG. 3, which represent the actuation elements b1 to b16 and/or the corresponding channel setting values of the filter bank, thus becomes a basis for a relative representation in respect of a basic setting and/or a "first fit". The user can however also implement a corresponding basic setting him/herself at any subsequent point in time and use it for standardization.

Following the basic setting of the filter bank and/or multi-channel system and a subsequent standardization, a relative change in the filter and/or setting values can be now be performed for further adjustment purposes (fine adjustment). As a result, an intuitive possibility is offered of carrying out changes to the current device configuration. It is namely easy to identify which channel or channels have been changed in relation to the basic setting. The quantity of the change can also be easily identified optically.

For additional orientation, the upper limit L, e.g. the maximum amplification power, can be superimposed in the graphics of FIG. 3. This is particularly helpful to identify which dynamic range is available in the respective channel.

Figure 4:
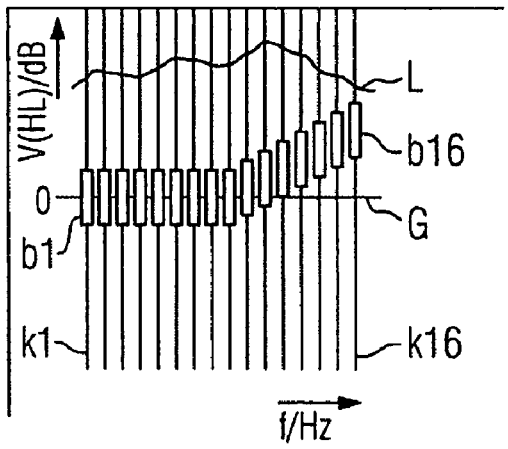
FIG. 4 shows a setting value combination (shape) for increasing the high frequencies in relation to the basic setting in a standardized representation.
Figure 5:
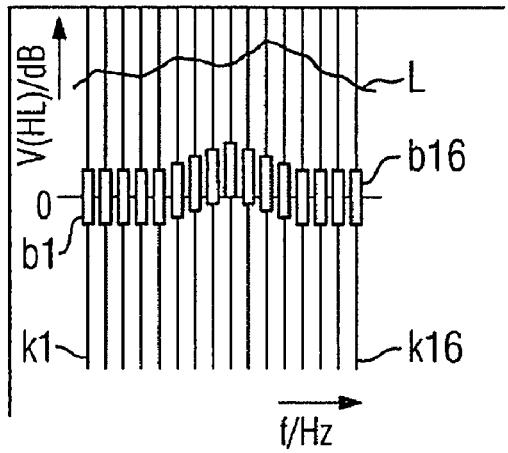
FIG. 5 shows a setting value combination for increasing the midrange frequencies in a standardized representation and FIG. 6 shows a setting value combination for lowering the low frequencies in a standardized representation.

Following a fine adjustment, in other words in relation to a basic setting, the setting value combination shown in FIG. 4 is provided for instance for the individual channels k1 to k16. In the present example, the seven highest frequency channels were raised slightly. In particular, the highest frequencies are raised more than the lower of the high frequencies, so that an approximately linear rise to the highest frequency results. The actuation elements b1 to b16 thus represent a certain adjustment and/or setting value combination, which is graphically reproduced in a so-called 'shape'. The 'shape' in FIG. 4 is used to raise the high frequencies. Different shapes can be determined for instance for different hearing situations. FIG. 5 also specifies a further concrete example, which reproduces a "shape" to raise the midrange frequencies.

Figure 6:
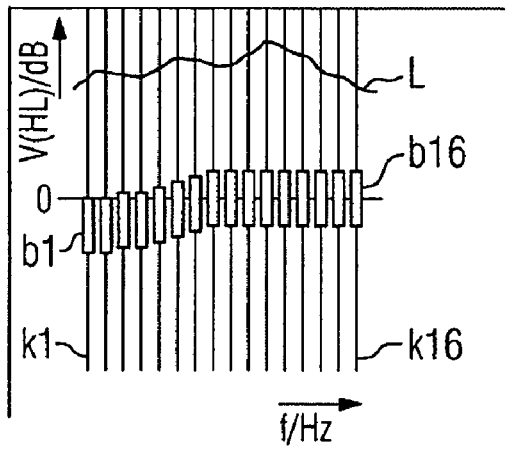

An example is likewise shown in FIG. 6, in which the low frequencies are lowered. This can likewise be easily seen from the standardized representation. The lowest frequency channels are thus attenuated in the selected example in relation to the basic setting. The attenuation increases as the frequency drops.

Optionally, prefabricated "shapes", as are shown in the examples in FIG. 4 to 6, can typically be provided by way of a drop-down menu. The user is then able to select an individual adjustment. Thus in a hearing situation with voice, the "shape" in FIG. 5 can be selected, so that the result is an "accentuation of voice". Furthermore, "shapes" for the hearing situations "classical music", "disco" etc. are also possible for instance, in order to reach the desired setting from the basic setting by way of the drop-down menu. Furthermore, other "shapes" can also be intuitively created by the user him/herself. In particular, the user has the possibility of standardizing the representation of an equalizer to any given point, providing him or her with intuitive handling of a large filter bank and he or she is able to realize his/her wishes easily and intuitively. He or she is however always able to intuitively revert to the basic setting.

The invention claimed is:

1. A method for adjusting a hearing device which has a multi-channel processing unit, comprising:

setting each individual processing value for each channel of the processing unit to a respective basic setting value which is individual to a hearing device wearer;

standardizing each of the processing values to the respectively associated basic setting value; and adjusting the processing values to the hearing device wearer relative to the standardized processing values, wherein the relative adjustments are facilitated via a drop-down menu, with which one of a number of predetermined relative adjustment value combinations, which represent relative adjustment values for all channels, can be selected.

2. The method as claimed in claim 1, further comprises optically representing the basic setting values and the relative adjustments of the processing values for each channel.

3. The method as claimed in claim 1, wherein a maximum value that cannot be exceeded via the relative adjustment is optically represented for each channel.

4. The method as claimed in claim 1, wherein the processing unit is a filter bank and the processing values are filter values.

5. The method as claimed in claim 4, further comprises optically representing the basic setting values and the relative adjustments of the processing values for each channel.

6. The method as claimed in claim 5, wherein a maximum value that cannot be exceeded via the relative adjustment is optically represented for each channel.

7. The method as claimed in claim 1, wherein a relative rise in the adjustment values only taking place in those channels which represent a midrange of acoustically perceptible frequencies.

* * * * *

UNITED STATES PATENT AND TRADEMARK OFFICE

CERTIFICATE OF CORRECTION

PATENT NO. : 8,111,850 B2
APPLICATION NO. : 12/079684
DATED : February 7, 2012
INVENTOR(S) : Michael Messmer and Andre Steinbuss It is certified that error appears in the above-identified patent and that said Letters Patent is hereby corrected as shown below:

IN THE CLAIMS:

Col. 4, Claim 5, line 55, 5. The method as claimed in claim "4" should read --1--.
Col. 4, Claim 6, line 58, 6. The method as claimed in claim "5" should read --1--.

Signed and Sealed this
Twenty-sixth Day of February, 2013

Teresa Stanek Rea
*Acting Director of the United States Patent and Trademark Office*